US005177412A

United States Patent [19]

Morohashi et al.

[11] Patent Number: 5,177,412

[45] Date of Patent: * Jan. 5, 1993

[54] COLOR CATHODE RAY TUBE APPARATUS

[75] Inventors: Katsusei Morohashi, Menuma; Shigeo Takenaka, Fukaya; Taketoshi Shimoma, Isesaki, all of Japan

[73] Assignee: Kabushiki Kaisha Toshiba, Kawasaki, Japan

[ * ] Notice: The portion of the term of this patent subsequent to Oct. 24, 2006 has been disclaimed.

[21] Appl. No.: 818,436

[22] Filed: Dec. 27, 1991

Related U.S. Application Data

[63] Continuation of Ser. No. 528,069, May 24, 1990, abandoned.

[30] Foreign Application Priority Data

May 26, 1989 [JP] Japan ..... 1-133778
May 31, 1989 [JP] Japan ..... 1-138245

[51] Int. Cl.[5] ..... G09G 1/04; H01J 29/51; H01F 7/00

[52] U.S. Cl. ..... 315/370; 315/368.27; 335/210

[58] Field of Search ..... 315/368.26, 368.27, 315/368.28, 368.18, 370, 371, 391, 394; 335/210, 213

[56] References Cited

U.S. PATENT DOCUMENTS

| | | | |
|---|---|---|---|
| 3,668,464 | 6/1972 | Tokita et al. | 315/370 |
| 3,849,749 | 11/1974 | Kadota | 335/210 |
| 4,755,714 | 7/1988 | Sluyterman | 313/440 |
| 4,876,478 | 10/1989 | Morohashi et al. | 313/413 |
| 4,881,015 | 11/1989 | Shimoma et al. | 315/371 |

FOREIGN PATENT DOCUMENTS

| | | | |
|---|---|---|---|
| 0115659 | 8/1984 | European Pat. Off. . | |
| 0207394 | 1/1987 | European Pat. Off. | 315/370 |
| 50-37971 | 12/1975 | Japan . | |
| 51-36135 | 10/1976 | Japan . | |
| 57-31339 | 7/1982 | Japan . | |
| 1407166 | 9/1925 | United Kingdom . | |

*Primary Examiner*—Gregory C. Issing
*Attorney, Agent, or Firm*—Cushman, Darby & Cushman

[57] ABSTRACT

A deflecting unit of a color cathode ray tube is constituted by a main deflecting section whose deflecting center is located on a phosphor screen side from an optimal deflecting center of the color cathode ray tube and at least one sub deflecting section whose deflecting center is located on an electron gun assembly side from the optimal deflecting center of the color cathode ray tube.

13 Claims, 8 Drawing Sheets

COLOR CATHODE RAY TUBE APPARATUS

This is a continuation of application Ser. No. 07/528,069, filed on May 24, 1990, which was abandoned upon the filing hereof.

BACKGROUND OF THE INVENTION

1. Field of the Invention

The present invention relates to a color cathode ray tube apparatus having a color cathode ray tube and a deflecting unit mounted outside the tube.

2. Description of the Related Art

A color cathode ray tube generally comprises a panel, a funnel continuous to the panel, and a tube having a cylindrical neck connected to the funnel. A shadow mask is arranged inside the panel, and a phosphor screen constituted by three color light emission layers for emitting red, green and blue beams is formed on the inner surface of the panel to oppose the shadow mask. An electron gun assembly for emitting three electron beams is arranged inside the neck portion. I order to deflect the three electron beams emitted from the electron gun assembly in horizontal and vertical directions, a deflecting unit is arranged outside the boundary between the neck and the funnel. A static convergence magnet and a purity magnet are arranged outside the neck.

In the above color cathode ray tube apparatus, in order to display an image without color misregistration, the three electron beams must be correctly landed on the three color phosphor layers, respectively. For this reason, a deflecting unit must be mounted on a correct portion of the color cathode ray tube. In addition, the positions of the static convergence magnet and the purity magnet must be adjusted to focus the three electron beams at one central point on the phosphor screen.

In the above color cathode ray tube apparatus, an in-line electron gun assembly for emitting a pair of side beams and a center beam in a line on the same horizontal plane is generally employed. In this in-line color cathode ray tube apparatus, a phosphor screen is constituted by phosphor stripe layers extending in the vertical direction.

In the in-line color cathode ray tube apparatus, a pincushion horizontal deflecting magnetic field which is a nonuniform magnetic field is generated to deflect electron beams in the horizontal direction, and a barrel vertical deflecting magnetic field which is a nonuniform magnetic field is generated to deflect the electron beams in the vertical direction. Therefore, correction of dynamic convergence using a external circuit is not necessary. However, the mounting positions of the deflecting device, the static convergence magnet, and the purity magnet must be adjusted.

An operator conventionally adjusts the mounting positions of the deflecting unit, the static convergence magnet and the purity magnet while watching the screen. There are various types of methods of adjusting the deflecting unit, i.e., rotation of the deflecting unit on the color picture tube, reciprocation of the deflecting unit in the axial direction of the tube to correctly radiate the three electron beams on the three color phosphor layers, and swinging of the deflecting unit on the phosphor side in vertical and horizontal directions to focus the three electron beams on a peripheral portion of the phosphor screen while the deflecting unit on the electron gun assembly side is fixed. The positions of the static convergence magnet and the purity magnet are generally adjusted by rotating three pairs of magnets, i.e., a total of six annular magnets, and all of the adjusting operations are manually performed by visual check. The adjusting operations must be repeated until an optimal adjustment state is obtained. Therefore, the adjustment requires skills and time-consuming operations.

In a large color picture tube which has a high production ratio compared with other picture tubes, it is difficult for one operator to adjust the positions of a deflecting unit, a static convergence magnet, and a purity magnet each located at the rear position of the picture tube while watching an image displayed on the front image display screen. Therefore, one operator watches the screen, and the other operator cooperates to adjust the positions. Otherwise, any adjusting tool is required to adjust the positions by one operator. Therefore, the adjustment requires a time-consuming operation, and an optimal adjusting operation is difficult to obtain.

As described above, in order to display an excellent image without color misregistration on the screen of the color picture tube, the mounting positions of the deflecting unit, the static convergence magnet, and the purity magnet must be adjusted. In these adjusting operations, there are many types of operations for particularly adjusting the deflecting unit on the color picture tube. That is, these operations include items for rotating the deflecting unit on the color picture tube, moving the unit in a direction of the tube axis and swinging the unit in the vertical and horizontal directions. Since an operator manually performs these adjusting operations while watching the screen, the adjustment requires skills and a time-consuming operation. In a large tube, in particular, since the adjusting operation cannot be performed by one operator, a pair of operators cooperate to adjust the deflecting unit or any special-purpose adjusting tool is required. Therefore, the adjustment is time-consuming and cannot be optimally performed.

SUMMARY OF THE INVENTION

The present invention has been made to solve the above problems, and has as its object to provide a color cathode ray tube apparatus capable of easily adjusting a deflecting unit for a color cathode ray tube and displaying an excellent image without color misregistration.

In a color cathode ray tube apparatus according to the present invention, a deflecting unit arranged on the outer surface of the tube is constituted by a main deflecting section whose deflecting center is located on a phosphor screen side from an optimal deflecting center of the cathode ray tube and a sub deflecting section whose deflecting center is located on an electron gun assembly side from the optimal deflecting center. Each of the main and sub deflecting sections has a horizontal deflecting coil for applying a horizontal deflecting magnetic field to a plurality of electron beams emitted from the electron gun assembly and a vertical deflecting coil for applying a vertical deflecting magnetic field to the plurality of electron beams. The horizontal deflecting magnetic field generated by the sub deflecting section is asymmetrical about the vertical axis on the horizontal plane, and the vertical deflecting magnetic field generated from the sub deflecting section asymmetrical about the horizontal axis on the vertical plane.

In the color cathode ray tube apparatus having the deflecting unit arranged on an envelope of the cathode ray tube, the deflecting unit has a main deflecting section arranged on the phosphor screen side from the optimal deflecting center of the cathode ray tube and a sub deflecting section arranged on the electron gun assembly side from the optimal deflecting center. A magnetic field generated by the main deflecting section is a pincushion magnetic field for deflecting magnetic field in a direction parallel to a plane containing an array of electron guns, and a magnetic field generated by the sub deflecting section is a barrel magnetic field. For this reason, a magnetic field, generated by the deflecting unit, for deflecting a plurality of electron beams in the above direction is formed in a barrel shape shifted to the sub deflecting section side from the deflecting center of the deflecting unit.

A color cathode ray tube apparatus according to the present invention has a deflecting unit capable of freely adjusting a deflecting state of electron beams, thereby easily adjusting a deflecting unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments according to the present invention will be described below with reference to the accompanying drawings.

Figure 1:
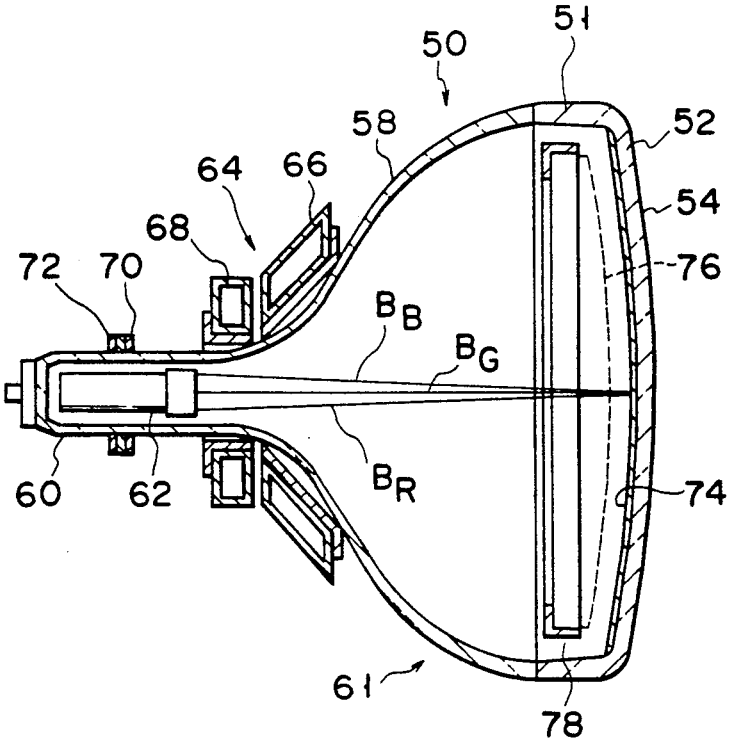
FIG. 1 is a sectional view of a color cathode ray tube apparatus according to an embodiment of the present invention.

FIG. 1 shows a part of a color cathode ray tube apparatus according to the first embodiment of the present invention. A color cathode ray tube apparatus 50 comprises a substantially rectangular faceplate 54, a panel section 52 having a skirt 51 extending from the peripheral portion of the faceplate, a funnel section 58 connected to the panel 52, and an envelope 61 having a neck section 60 continuous to the funnel section. The interior of the cathode ray tube is kept in a vacuum state by the panel 52, the funnel 58, and the neck 60. An electron gun assembly 62 for generating three electron beams $B_R$, $B_G$, and $B_B$ is housed in the neck section 60 A deflecting unit 64 having a horizontal deflecting coil for generating a magnetic field to deflect the electron beams $B_R$, $B_G$, and $B_B$ in the horizontal direction and a vertical deflecting coil for generating a magnetic field to deflect the electron beams in a vertical direction is arranged on the outer surface of the funnel section 58 and the neck section 60. The deflecting unit 64 has a main deflecting section 66 and a sub deflecting section 68. Static convergence and purity magnets 70 and 72 for adjusting tracks of the electron beams $B_R$, $B_G$ and $B_B$ are arranged on the outer surface of the neck section 60.

A phosphor screen 74 is formed on the inner surface of the faceplate 54 of the panel section 52. A substantially rectangular shadow mask 76 is arranged to form a gap with the faceplate 54 and to face the phosphor screen 74 in the tube. The shadow mask 76 is made of a thin metal plate and has a large number of apertures. A mask frame 78 for supporting the shadow mask 76 is arranged around the shadow mask 76. The mask frame 78 is supported on the panel 52 by a plurality of elastic support members (not shown).

Figure 2:
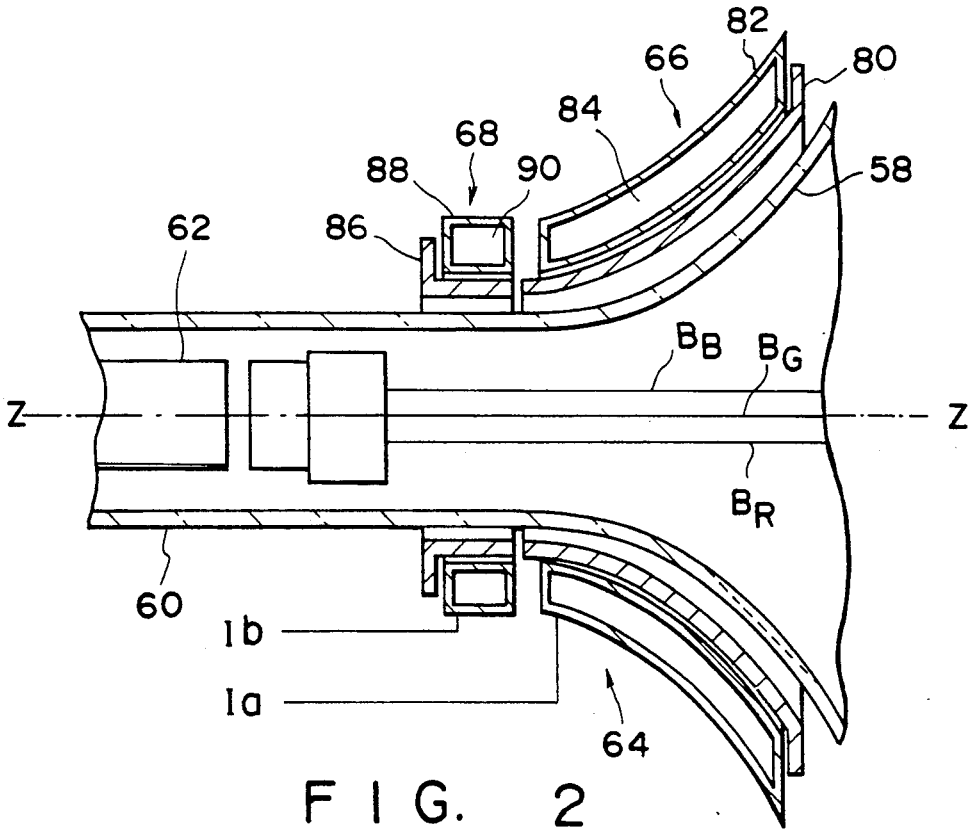
FIG. 2 is a sectional view showing an enlarged part of the color cathode ray tube apparatus shown in FIG. 1.

FIG. 2 is an enlarged view of parts of the funnel section 58 and the neck section 60. The main deflecting section 66 of the deflecting unit 64 has a pair of saddle horizontal deflecting coils 80 and a pair of toroidal vertical deflecting coils 82 wound around a core 84. The sub deflecting section 68 of the deflecting unit 64 has a pair of saddle horizontal deflecting coils 86 and a pair of toroidal vertical deflecting coils 88 wound around a core 90. In addition, the sub deflecting section 68 also has a sub coil (not shown). Synchronous currents having different current values determined by the deflecting coils are supplied to the main and sub deflecting sections 66 and 68 of the deflecting unit 64, respectively. A current synchronized with these currents is supplied to the sub coil (not shown). For this reason, the coils are connected to a passive circuit having resistors or LCs as circuit elements.

Figure 3A:
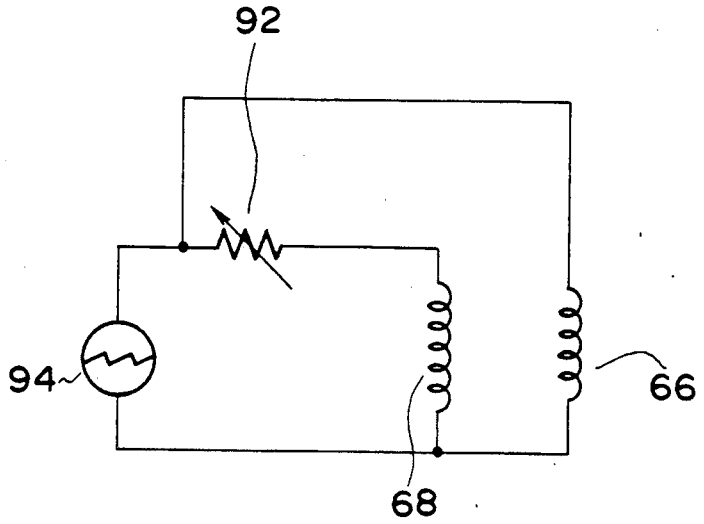
FIGS. 3A and 3B are circuit diagrams showing circuits connected to deflecting coils of the present invention.
Figure 3B:
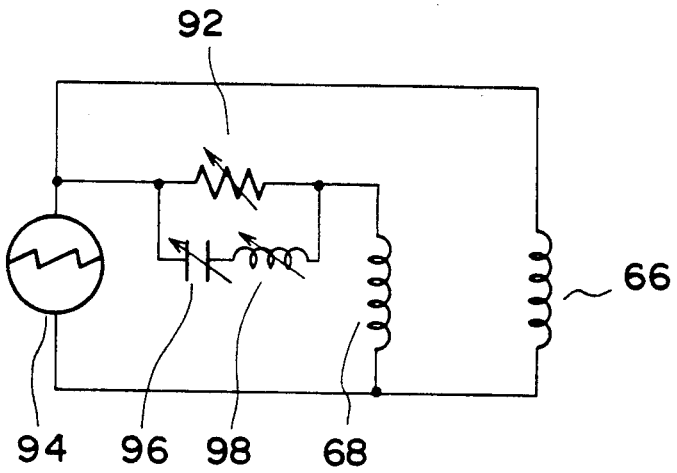

Examples of the passive circuit are shown in FIGS. 3A and 3B. These passive circuits are simple and inexpensive. In the example in FIG. 3A, the main deflecting section 66 is connected to a deflecting power source 94. The sub deflecting section 68 and a variable resistor 92 connected in parallel with the main deflecting section 66 ar connected in series with the deflecting power source 94. By adjusting the resistance of the variable resistor, the currents of the sub and main deflecting sections 68 and 66 are adjusted. This passive circuit may be employed for a horizontal deflecting coil or a vertical deflecting coil. In the example in FIG. 3B, a varactor 96 and a variable inductor 98 are added to the circuit in FIG. 3A. This example is effective when a waveform must be corrected due to a change in current of deflecting units. Note that the present invention is not limited to the above two examples, the variable resistor, the varactor, and the variable inductor may be connected to the main deflecting section instead of the sub section. In the above circuit, elements may be variably connected in series or parallel with each other. Each of the circuit elements may be singly used. In addition to the passive elements, an active element can be connected to the above circuit elements.

During assembly, the deflecting unit 64 is arranged so that a deflecting center of the main deflecting section 66 is located on the phosphor screen side from an optimal deflecting center of a cathode ray tube and the deflecting center of the whole deflecting unit 64 is located on the electron gun assembly side from the optimal deflecting center of the cathode ray tube when the same deflecting currents are supplied to the main deflecting section 66 and the sub deflecting section 68.

Figure 4:
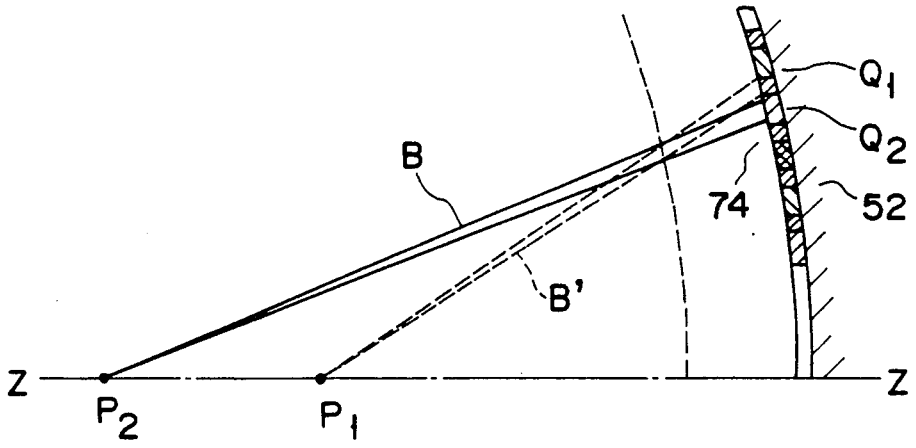
FIG. 4 is a view for explaining a relationship between a state of a deflecting center of a deflecting unit and states of electron beams landed into a phosphor screen.
Figure 5:
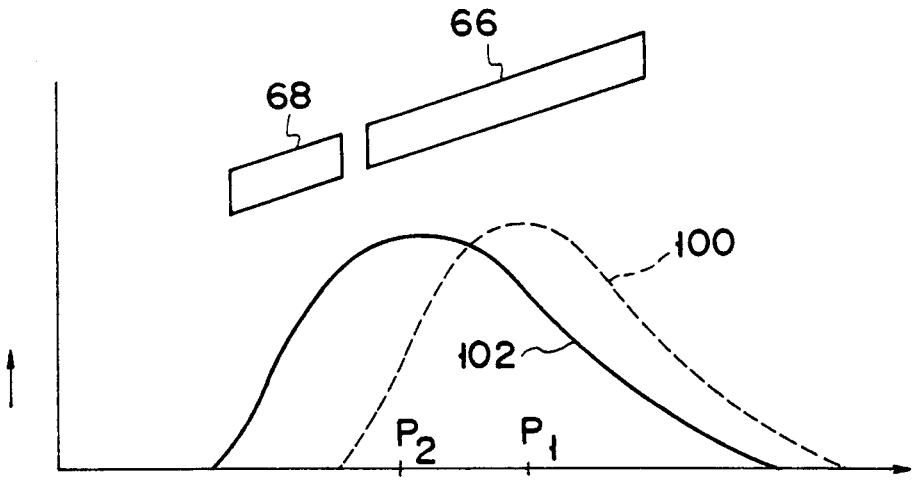
FIG. 5 is a view for explaining the deflecting center of the deflecting unit.

When deflecting currents supplied to the main and sub deflecting sections 66 and 68 of the deflecting unit 64 are denoted by reference symbols Ia and Ib, respectively, the deflecting current Ib of the sub deflecting section 68 can be adjusted to fall within the following range:

$$0 \leqq Ib \leqq Ia$$

thereby obtaining the same effect as in a conventional deflecting unit. That is, as shown in FIG. 4, when the deflecting center of the deflecting unit is located on an optimal deflecting position P2, an electron beam B passing through a shadow mask is landed on a phosphor Q2 located at a correct position on the phosphor screen. However, when the deflecting center of the deflecting unit is located at a position P1 located on the phosphor side from the optimal deflecting position P2, an electron beam B' passing through the shadow mask is landed on a phosphor Q1 located at an incorrect position on the phosphor screen. The deflecting current Ia of the main deflecting section 66 and the deflecting current Ib of the sub deflecting section 68 are adjusted to set the deflecting unit to an optimal deflecting position. As shown in FIG. 5, when a magnetic field deflected by the sub deflecting section 68 is added to a magnetic field intensity distribution 100 ($Ia \neq 0$, $Ib = 0$) generated by only the main deflecting section 66, the magnetic field intensity distribution 100 is changed to a magnetic field intensity distribution 102 ($Ia \neq 0$, $Ib \neq 0$). For this reason, the magnetic field can be set to an optimal deflecting position. As a result, according to the present invention, the same effect as movement of the conventional deflecting unit can be obtained.

Figure 6:
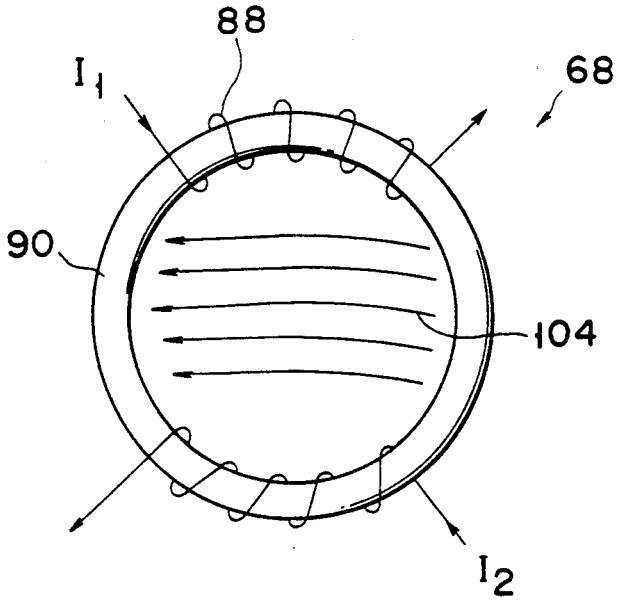
FIG. 6 is a view for explaining a relationship between a current supplied to a pair of vertical deflecting coils of a sub deflecting section of the deflecting unit according to the present invention and a vertical deflecting magnetic field generated by the current.
Figure 7A:
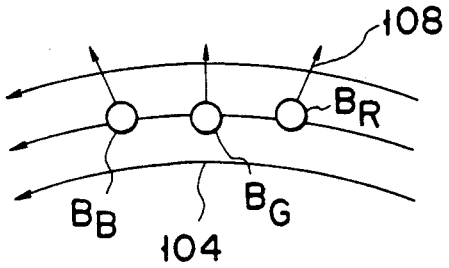
FIGS. 7A and 7B are views showing a direction of force acting on the electron beams by a vertical deflecting magnetic field asymmetrical in a direction perpendicular to the drawing surface.
Figure 7B:
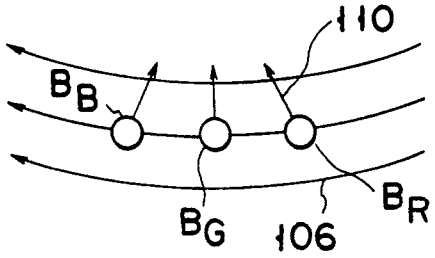

The horizontal and vertical deflecting magnetic fields generated by he horizontal and vertical coils 86 and 88 of the sub deflecting section 68 are asymmetrical about vertical and horizontal axes, respectively. Therefore, the same effect as a conventional swinging operation for adjusting the position of the deflecting unit can be obtained. FIG. 6 shows a pair of toroidal vertical deflecting coils 88 wound around the core 90 of the sub deflecting section 68. When values I1 and I2 of currents supplied to the vertical deflecting coils 88 are equal to each other, magnetic fields 104 and 106 as shown in FIGS. 7A and 7B are generated. The magnetic fields 104 and 106 are generated to be asymmetrical about the horizontal axis. The three electron beams $B_R$, $B_G$, and $B_B$ receive a force from the magnetic fields 104 and 106 in directions of arrows 108 and 110. In the arrow 108, the three electron beams $B_R$, $B_G$, and $B_B$ receive a repulsion force to be separated from each other. In the arrow 110, the three electron beams $B_R$, $B_G$, and $B_B$ receive a force to cause them to come close to each other. Therefore, a convergence error can be corrected.

Figure 8:
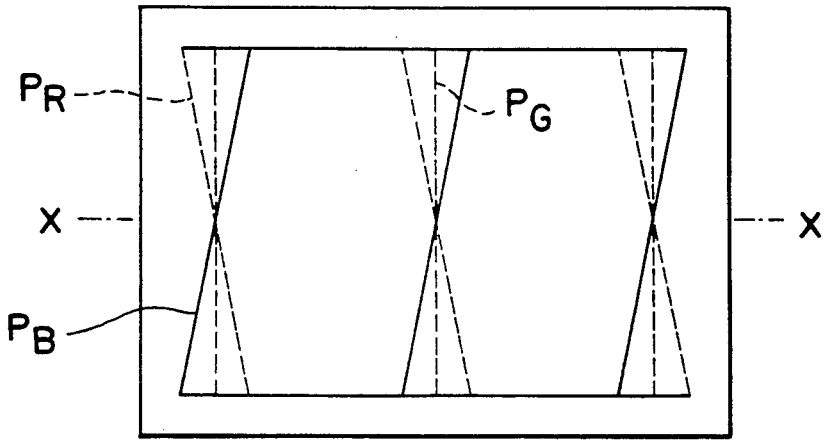
FIG. 8 is a view showing a convergence error caused by a cross pattern of a pair of side beams

A method of controlling a deflecting magnetic field using this deflecting unit will be described below. When a convergence error occurs wherein patterns of the pair of side beams $B_R$ and $B_B$ form a cross pattern asymmetrical about the horizontal axis (X-axis) as shown in FIG. 8, the currents I1 and I2 ($I1 < I2$) are supplied to the vertical deflecting coils 88 shown in FIG. 6. For this reason, the upper and lower vertical deflecting magnetic fields asymmetrical about the horizontal axis are generated, and the pair of side beams $B_R$ and $B_B$ receive the repulsion force to be separated from each other. As a result, the above convergence error can be corrected.

Figure 9:
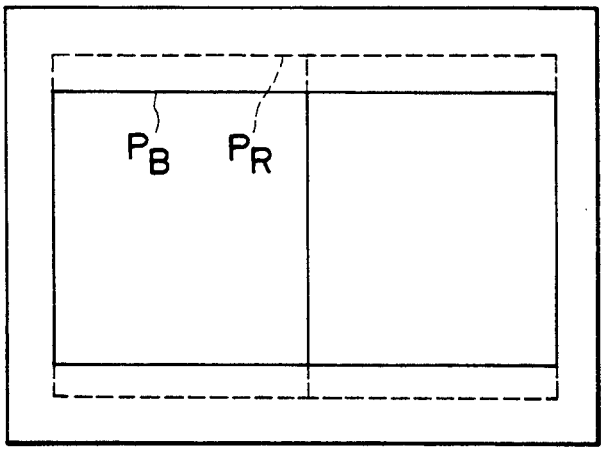
FIG. 9 is a view showing a convergence error wherein sizes of patterns of the pair of side beams are different from each other in the direction perpendicular to the drawing surface.
Figure 10:
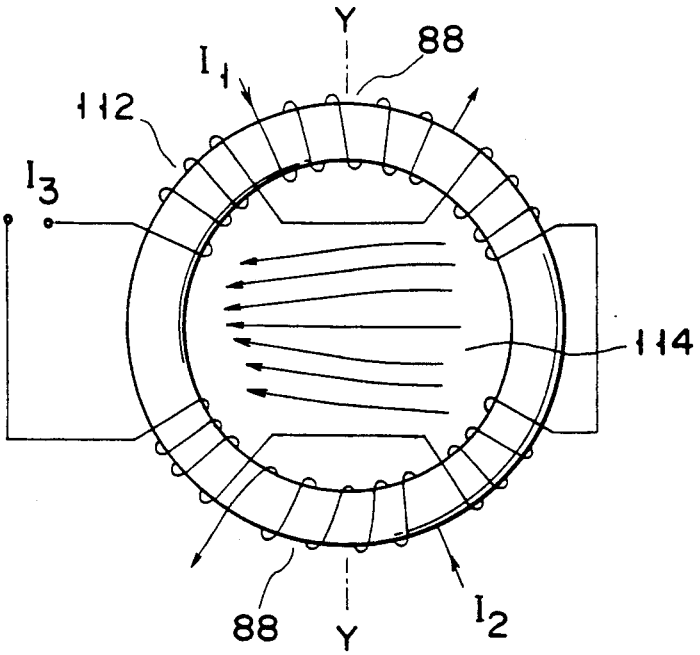
FIG. 10 is a view showing a pair of upper and lower vertical deflecting coils with respect to the drawing surface and a sub coil of the sub deflecting section to correct the convergence error in FIG. 9 according to the present invention.

As shown in FIG. 9, when a convergence error occurs wherein one of lower and upper patterns formed by the pair of side beam $B_R$ and $B_B$ is smaller than the other, a toroidal vertical deflecting coil 88 and a sub coil 112 are wound around the core 90 is shown in FIG. 10. An arbitrary current synchronized with the currents of the vertical deflecting coils 88 is supplied to the sub coil 112, thereby correcting the above convergence error. That is, when the currents supplied to the pair of vertical deflecting coils 88 are equal to each other and a current I3 supplied to the sub coil 112 is set to 0, a vertical deflecting magnetic field asymmetrical about the vertical axis (Y-axis) is formed. However, when only the current I3 supplied to the sub coil 112 is set to 0, a vertical deflecting magnetic field 114 asymmetrical in the horizontal plane is generated. Since the electron beams receives a force from the vertical deflecting magnetic field 114 in the vertical direction, the above convergence error is corrected.

Figure 11:
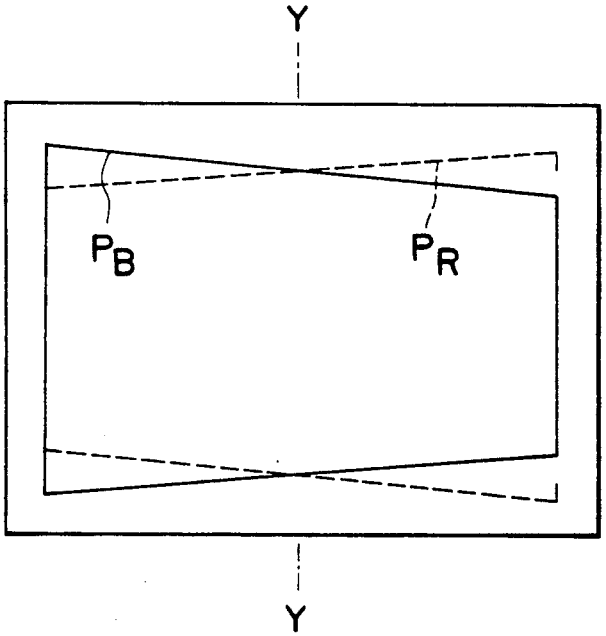
FIG. 11 is a view showing a convergence error wherein patterns of the pair of side beams are asymmetrical about the vertical axis.

As shown in FIG. 11, when a convergence error for causing a cross pattern vertically asymmetrical about the vertical axis (Y-axis) occurs in the patterns $P_R$ and $P_B$ formed by the pair of side beams $B_R$ and $B_B$, the horizontal deflecting coil 86 of the sub deflecting section 68 is synchronized with the vertical deflecting coil 88, and vertically unbalanced currents are supplied to these coils. The horizontal deflecting magnetic field is synchronized with the vertical deflecting magnetic field to be dynamically changed, thereby correcting the convergence error.

The method of correcting the convergence error has been described above, and a convergence error and image distortion except for vertical pincushion distortion can be corrected by properly changing the deflecting magnetic field.

In addition, the vertical deflecting magnetic field of the main deflecting magnetic field has a pincushion distribution, and the vertical deflecting magnetic field of the sub deflecting magnetic field has a barrel distribution. Therefore, the convergence error and the image distortion can be excellently corrected.

In the first embodiment, the saddle horizontal deflecting coils of the main and sub deflecting sections are used, and the toroidal vertical deflecting coils are used. These coils are not limited to the above types, and various types of coils can be used.

Figure 12:
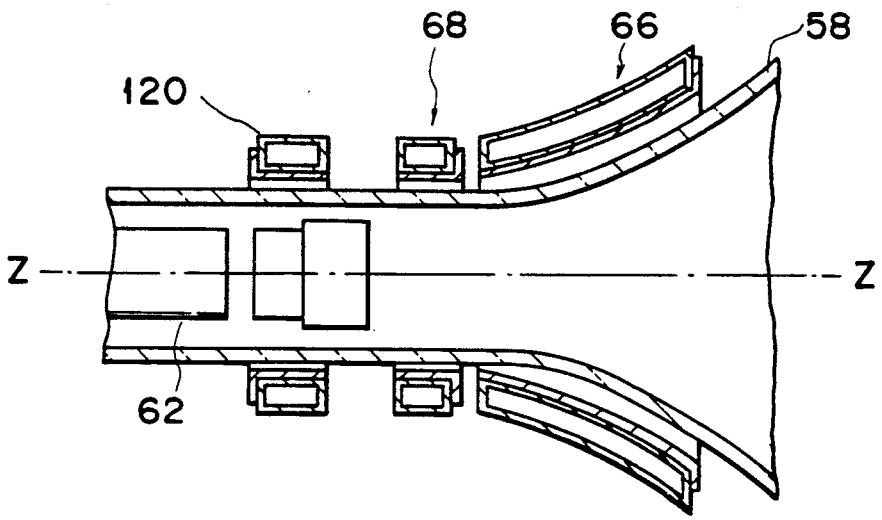
FIG. 12 is a view showing a modification of the first embodiment of the present invention.

A modification of the first embodiment will be described below. In the modification, a second sub deflecting section is added to the sub deflecting section of the deflecting unit of the first embodiment. The second sub deflecting section 120 is shown in FIG. 12. The second sub deflecting section 120 is arranged on the neck section 60 around the electron gun assembly 62. The second sub deflecting section 120 deflects electron beams radiated from the electron gun assembly 62 in a direction perpendicular to the tube axis (Z-axis) before the electron beams are radiated into the main and sub deflecting sections 66 and 68 to correct a convergence error. For example, the convergence error shown in FIG. 8 is corrected by slightly deflecting the three electron beams to an upper direction. The convergence error shown in FIG. 9 is corrected by deflecting the three electron beams to the side of one of the side beams. Thus, since the second sub deflecting section is arranged, a color cathode ray tube apparatus having a deflecting unit capable of fine correction can be provided.

FIG. 1 shows a part of a color cathode ray tube apparatus according to the second embodiment of the present invention. The second embodiment has the same arrangement as the first embodiment. A color cathode ray tube apparatus 50 comprises a substantially rectangular faceplate 54, a panel section 52 having a skirt 51 extending from the peripheral portion of the faceplate, a funnel section 58 connected to the panel 52, and an envelope 61 having a neck section 60 continuous to the funnel section. The interior of the cathode ray tube is kept in a vacuum state by the panel 52, the funnel 58, and the neck 60. An electron gun assembly 62 for 15 generating three electron beams $B_R$, $B_G$, and $B_B$ is housed in the neck section 60. A deflecting unit 64 having the horizontal deflecting coil for generating a magnetic field to deflect the electron beams $B_R$, $B_G$, and $B_B$ in the horizontal direction and a vertical deflecting coil for generating a magnetic field to deflect the electron beams in a vertical direction is arranged on the outer surface of the funnel section 58 and the neck section 60. The deflecting unit 64 has a main deflecting section 66 and a sub deflecting section 68. Static convergence and purity magnets 70 and 72 for adjusting tracks of the electron beams $B_R$, $B_G$ and $B_B$ are arranged on the outer surface of the neck section 60.

A phosphor screen 74 is formed on the inner surface of the faceplate 54 of the panel section 52. A substantially rectangular shadow mask 76 is arranged to form a gap with the faceplate 54 and to face the phosphor screen 74 in the tube. The shadow mask 76 is made of a thin metal plate and has a large number of apertures. A mask frame 78 for supporting the shadow mask 76 is arranged around the shadow mask 76. The mask frame 78 is supported on the panel 52 by a plurality of elastic support members (not shown).

FIG. 2 is an enlarged view of parts of the funnel section 58 and the neck section 60. The main deflecting section 66 of the deflecting unit 64 has a pair of saddle horizontal deflecting coils 80 and a pair of toroidal vertical deflecting coils 82 wound around a core 84. The sub deflecting section 68 of the deflecting unit 64 has a pair of saddle horizontal deflecting coils 86 and a pair of toroidal vertical deflecting coils 88 wound around a core 90. In addition, the sub deflecting section 68 also has a sub coil (not shown). Synchronous currents having different current values determined by the deflecting coils are supplied to the main and sub deflecting sections 66 and 68 of the deflecting unit 64, respectively. A current synchronized with these currents is supplied to the sub coil (not shown). For this reason, the coils are connected to a passive circuit having resistors or LCs as circuit elements. Thus, this circuit is the same circuit as in the first embodiment.

The horizontal deflecting coil 80 of the main deflecting section 66 generates a pincushion horizontal deflecting magnetic field, and the vertical deflecting coil 82 generates a barrel vertical deflecting magnetic field. The horizontal and vertical deflecting coil 86 and 88 generate barrel horizontal and vertical deflecting magnetic fields, respectively.

Figure 13:
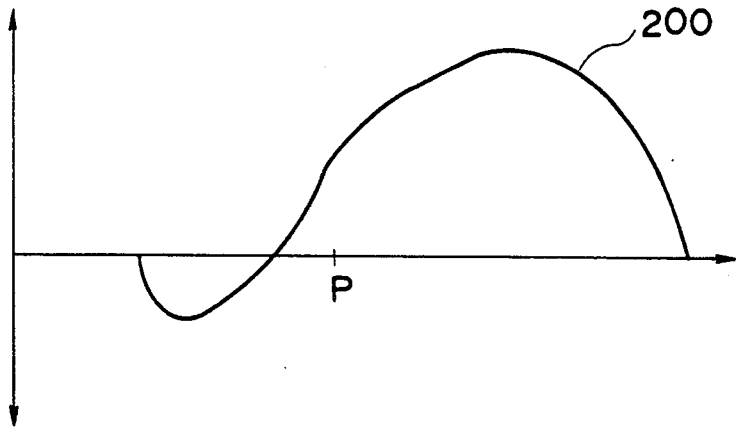
FIG. 13 is a view showing a horizontal deflecting magnetic field distribution on a tube axis of the deflecting unit according to the second embodiment.

An intensity of the horizontal deflecting magnetic field generated by the deflecting unit is shown in FIG. 13 by a curve 200. The horizontal deflecting magnetic field of the whole deflecting unit has a pincushion distribution as a whole, and the horizontal deflecting magnetic field has a barrel magnetic distribution on the sub deflecting section side from the deflecting center of the whole deflecting unit.

During assembly, the deflecting unit 64 is arranged so that a deflecting center of the main deflecting section 66 is located on the phosphor screen side from an optimal deflecting center of a cathode ray tube and the deflecting center of the whole deflecting unit 64 is located on the electron gun assembly side from the optimal deflecting center of the cathode ray tube when the same deflecting currents are supplied to the main deflecting section 66 and the sub deflecting section 68.

When deflecting currents supplied to the main and sub deflecting sections 66 and 68 of the deflecting unit 64 are denoted by reference symbols Ia and Ib, respectively, the deflecting current Ib of the sub deflecting section 68 can be adjusted to fall within the following range:

$$0 \leqq Ib \leqq Ia$$

thereby obtaining the same effect as in a conventional deflecting unit. That is, as shown in FIG. 4, when the deflecting center of the deflecting unit is located on an optimal deflecting position P2, an electron beam B passing through a shadow mask is landed on a phosphor Q2 located at a correct position on the phosphor screen. However, when the deflecting center of the deflecting unit is located at a position P1 located on the phosphor side from the optimal deflecting position P2, an electron beam B' passing through the shadow mask is landed on a phosphor Q1 located at an incorrect position on the phosphor screen. The deflecting current Ia of the main deflecting section 66 and the deflecting current Ib of the sub deflecting section 68 are adjusted to set the deflecting unit to an optimal deflecting position. As shown in FIG. 5, when a magnetic field deflected by the sub deflecting section 68 is added to a magnetic field intensity distribution 100 (Ia≠0, Ib=0) generated by only the main deflecting section 66, the magnetic field intensity distribution 100 is changed to a magnetic field intensity distribution 102 (Ia≠0, Ib≠0). For this reason, the magnetic field can be set to an optimal deflecting position. As a result, according to the present invention, the same effect as a conventional movement of the deflecting unit can be obtained.

In the deflecting unit 64, the horizontal deflecting magnetic field has a barrel distribution shifted to the sub deflecting section 68 side from the deflecting center of the whole deflecting unit. Therefore, even if the three electron beams are radiated into the deflecting magnetic field while being deviated from the tube axis in the horizontal direction, excellent convergence characteristics can be obtained without a convergence error at the end of the horizontal axis in the horizontal direction.

Figure 14A:
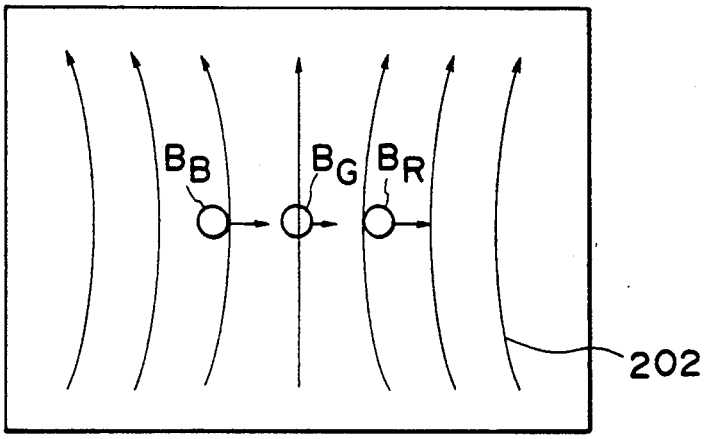
FIGS. 14A and 14B are views for explaining an influence of a pincushion horizontal deflecting magnetic field in convergence of three electron beams.
Figure 14B:
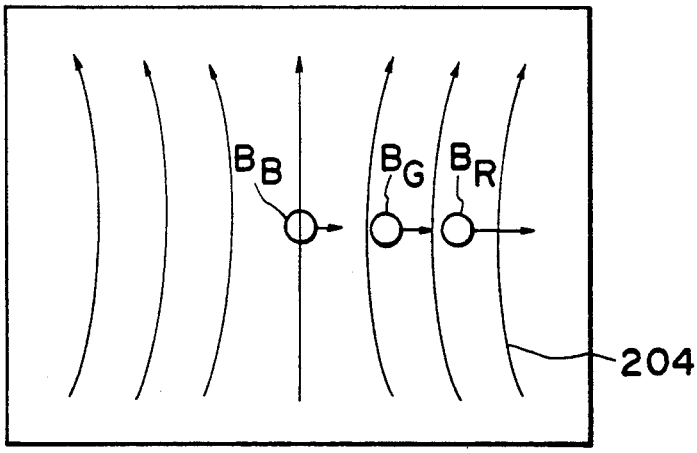

That is, in a pincushion horizontal deflecting magnetic field of the deflecting unit, when the three electron beams $B_R$, $B_G$, and $B_B$ are correctly radiated into the pincushion horizontal magnetic field 202 so that their center corresponds to the tube axis as shown in FIG. 14A, the pair of side beams $B_R$ and $B_B$ are almost equally deflected by the magnetic field 202, thereby obtaining an excellent convergence at the end of the screen in the horizontal axis. However, as shown in FIG. 14B, when the center of the three electron beams $B_R$, $B_G$, and $B_B$ radiated into a horizontal deflecting magnetic field 204 does not correspond to the tube axis, a convergence error occurs at the end of the screen in the horizontal axis. A deviation occurs between the three electron beams $B_R$, $B_G$, and $B_B$ radiated into the deflecting magnetic field 204 and the tube axis when chromatic purity at the center of the screen is adjusted by a permanent magnet 70. In a conventional method, the chromatic purity is adjusted by swinging the deflecting unit. The horizontal deflecting magnetic field of the sub deflecting section 68 has a barrel distribution. The horizontal deflecting magnetic field has a pincushion distribution as a whole, and the horizontal deflecting magnetic field has a barrel distribution shifted to the sub deflecting section 68 side from the deflecting center of the whole deflecting unit 64. In this case, even if the three electron beams $B_R$, $B_G$, and $B_B$ are radiated into the horizontal deflecting magnetic field while being deviated from the tube axis, the equal deflecting forces act on the pair of side beams $B_R$ and $B_B$. Therefore, excellent convergence can be obtained at the end of the screen in the horizontal axis.

In addition, even if the horizontal deflecting magnetic field of the sub deflecting section 6 has a barrel distribution, assume that the deflecting unit 64 is separated into the main and sub deflecting sections 66 and 68, that the horizontal deflecting magnetic field has a pincushion distribution of the whole deflecting unit 64 and, that the vertical deflecting magnetic field has a barrel distribution. A convergence error and picture distortion except for pincushion distortion can be easily corrected by arbitrarily changing the deflecting magnetic field. In addition, since the vertical deflecting magnetic fields of the main and sub deflecting sections 66 and 68 have pincushion and barrel distributions, respectively, a convergence error and picture distortion can be excellently corrected.

A deflecting unit mounted outside the envelope of the color picture tube is constituted by a main deflecting section whose deflecting center is located on the phosphor screen side from an optimal deflecting center of the color picture tube and a sub deflecting section whose deflecting center is located on the electron gun assembly side from the optimal deflecting center. Horizontal and vertical coils for forming horizontal and vertical deflecting magnetic fields are arranged on the main deflecting section, and horizontal and vertical deflecting coils for forming horizontal and vertical magnetic fields and a sub coil are arranged o the sub deflecting section. In this case, when the horizontal deflecting magnetic field of the sub deflecting section is horizontally asymmetrical about the vertical axis or the vertical deflecting magnetic field is vertically asymmetrical about the horizontal axis, the deflecting center can be electrically reciprocated in a direction of the tube axis. In addition, when the horizontal deflecting magnetic field of the sub deflecting section is horizontally asymmetrical about the vertical axis and the vertical deflecting magnetic field is vertically asymmetrical about the horizontal axis, various type of convergence errors and image distortion can be electrically corrected without swinging adjustment of the deflecting unit. Thus, the deflecting unit of the color picture tube can be correctly and rapidly adjusted, and the color picture tube having excellent screen quality can be provided.

A magnetic field for deflecting a plurality of beams in a direction parallel to a plane containing an array of electron guns (the direction being hereinafter referred to as "the array direction") by the main deflecting section has a pincushion distribution, and a magnetic field for deflecting the plurality of beams in the same direction has a barrel distribution. When the magnetic field for defecting the plurality of beams in the array direction has a barrel distribution shifted to the sub deflecting side from the deflecting center of the whole deflecting unit, the deflecting center can be reciprocated in a direction of the tube axis by adjusting deflecting currents supplied to the main and su deflecting sections. In addition chromatic purity of the peripheral portion of the screen conventionally adjusted by moving the deflecting unit in the direction of the tube axis can also be electrically adjusted. The magnetic field for deflecting the plurality of beams in the array direction of the beams by the barrel deflecting magnetic field generated by the sub deflecting unit has a barrel distribution shifted to the sub deflecting unit side from the deflecting center of the whole deflecting unit. Even if a plurality of inline beams are radiated into the deflecting magnetic field while being deviated from the tube axis in the array direction, a convergence error can be eliminated. Therefore, a swinging operation of the deflecting unit is unnecessary, although this operation has been conventionally performed as a method of adjusting convergence when the plurality of in-line beams are radiated into the deflecting magnetic field of the deflecting unit while being deviated from the tube axis in the array direction.

Additional advantages and modifications will readily occur to those skilled in the art. Therefore, the invention in its broader aspects is not limited to the specific details, representative devices, shown and described herein. Accordingly, various modifications may be made without departing from the spirit or scope of the general inventive concept as defined by the appended claims and their equivalents.

What is claimed is:

1. A color cathode ray tube apparatus comprising:

a vacuum envelope including a panel section having an axis, the panel section including:

a faceplate having an inner surface, and a skirt extending from a peripheral edge of said faceplate, a funnel section which enlarges into and connected to the panel section, and a neck section continuous with the funnel section and having a substantially cylindrical shape;

a phosphor screen formed on the inner surface of said faceplate;

a shadow mask arranged in said panel section for disposing said phosphor screen against said faceplate;

an in-line electron gun assembly including an electron beam forming section for generating, controlling, and accelerating three electron beams and a main electron lens section for converging and focusing the three electron beams onto said phosphor screen; and a deflecting unit for deflecting the three electron beams in vertical and in horizontal directions, the deflecting unit including a main deflecting section, whose deflecting center is located towards said phosphor screen relative to an optimal deflecting center of said color cathode ray tube, the main deflecting section having a first horizontally deflecting coil for generating a magnetic field for deflecting the three beams in the horizontal direction and a first vertically deflecting coil for generating a magnetic field for deflecting the three beams in the vertical direction and at least one sub deflecting section whose deflecting center is located towards the electron gun assembly relative to the optimal deflecting center of said color cathode ray tube, the sub deflecting section having a second horizontally deflecting coil for generating a magnetic field for deflecting the three beams in the horizontal direction and a second vertically deflecting coil for generating a magnetic field for deflecting the three beams in the vertical direction wherein at least one of the second horizontally deflecting coil and the second vertically deflecting coil generates an asymmetric magnetic field, and when only the second horizontally deflecting coil generates an asymmetric magnetic field, the magnetic field generated thereby is asymmetric with respect to a vertical axis, and when only the second vertically deflecting coil generates an asymmetric magnetic field, the magnetic field generated thereby is asymmetric with respect to a horizontal axis, and when each of the second horizontally deflecting coil and the second vertically deflecting coil generates an asymmetric magnetic field, the magnetic field generated by the second horizontally deflecting coil is asymmetric with respect to the vertical axis and the magnetic field generated by the second vertically deflecting coil is asymmetric with respect to the horizontal axis.

2. An apparatus according to claim 1, wherein said horizontally deflecting coil of said main deflecting section is in a saddle shape.

3. An apparatus according to claim 1, wherein said vertically deflecting coil of said main deflecting section is in a toroidal shape.

4. An apparatus according to claim 1, wherein said asymmetric horizontally deflecting coil of said sub deflecting section is in a saddle shape.

5. An apparatus according to claim 1, wherein said asymmetric vertically deflecting coil of said sub deflecting section is in a toroidal shape.

6. An apparatus according to claim 1, wherein said at least one sub deflecting section comprises one sub deflecting section.

7. An apparatus according to claim 1, wherein said sub deflecting section further comprises a sub coil.

8. An apparatus according to claim 1, wherein current supplied to said main deflecting section is at minimum equal to current supplied to said sub deflecting section.

9. An apparatus for deflecting electron beams inside a color cathode ray tube, the deflecting apparatus having a main section and at least one sub section, the sub section comprising:

an asymmetric horizontally deflecting coil for generating a first magnetic field for deflecting the electron beams in horizontal directions, the first magnetic field being asymmetric with respect to a vertical plane asymmetrically splitting the deflecting apparatus; and an asymmetric vertically deflecting coil for generating a second magnetic field for deflecting the electron beams in vertical directions, the second magnetic field being asymmetric with respect to a horizontal plane symmetrically splitting the deflecting apparatus.

10. An apparatus according to claim 9, wherein said asymmetric horizontally deflecting coil comprises a saddle-shaped coil.

11. An apparatus according to claim 9, wherein said asymmetric vertically deflecting coil comprises a toroid-shaped coil.

12. An apparatus according to claim 9, wherein said sub section further comprises a sub coil.

13. An apparatus according to claim 9, wherein current supplied to said main section is at minimum equal to current supplied to said sub section.

* * * * *